US006605059B1

(12) United States Patent
Middleton

(10) Patent No.: US 6,605,059 B1
(45) Date of Patent: Aug. 12, 2003

(54) HYPODERMIC DART

(76) Inventor: David Russell Middleton, PO Box 626, Lilydale VIC 3140 (AU)

( * ) Notice: Subject to any disclaimer, the term of this patent is extended or adjusted under 35 U.S.C. 154(b) by 0 days.

(21) Appl. No.: 09/926,013

(22) PCT Filed: Feb. 16, 2000

(86) PCT No.: PCT/AU00/00108

§ 371 (c)(1),
(2), (4) Date: Oct. 26, 2001

(87) PCT Pub. No.: WO00/48653

PCT Pub. Date: Aug. 24, 2000

(30) Foreign Application Priority Data

Feb. 16, 1999 (AU) ..... PP8723

(51) Int. Cl.[7] ..... A61M 5/20
(52) U.S. Cl. ..... 604/130
(58) Field of Search ..... 604/130; 473/581, 473/585

(56) References Cited

U.S. PATENT DOCUMENTS 3,820,465 A * 6/1974 Delphia ..... 604/130
4,121,586 A 10/1978 Lawrence et al.
4,243,036 A * 1/1981 Ott ..... 604/130

FOREIGN PATENT DOCUMENTS

GB 2 033 554 5/1980
WO 92/06723 4/1992

* cited by examiner

*Primary Examiner*—Brian L. Casler
*Assistant Examiner*—Matthew F DeSanto
(74) *Attorney, Agent, or Firm*—Hoffman, Wasson & Gitler

(57) ABSTRACT

A plunger located in the barrel, which is in sealing engagement with, and movable along the barrel, towards or away from the needle, and an aperture extending from the barrel rearward of the plunger in its loaded position communicating between the tubular member and an area in the barrel rearward of the plunger, and sealing means mounted on the syringe rearward of the aperture for sealingly engaging the tubular member.

20 Claims, 6 Drawing Sheets

HYPODERMIC DART

This application is a 371 of PCT/AU00/00108, filed on Feb. 16, 2000.

FIELD OF THE INVENTION

The invention relates to a dart. In particular a dart for use with animals or humans.

BACKGROUND OF THE INVENTION

Animal syringe darts exist for the specific purpose of remotely injecting substances (eg a tranquilliser) into animals. Such a system is necessary in every case where it is not possible to either physically capture and handle the animal or to administer substances by other indirect means (eg orally).

Existing systems differ with respect to two components:

1) The mechanism used to inject the substance; and
2) The mechanism used to bring the syringe into contact with the animal.

Current injection mechanisms all have certain disadvantages.

Chemical reaction mechanisms rely on the mixture of reactants at the time of impact to create carbon dioxide expanding the delivery chamber and effecting injection. The most common system used is the pre-pressurised mechanism. The disadvantages of this system are that the apparatus must remain pressurised until the moment of impact (they often leak). Further, the pre-pressurised dart may accidentally discharge and inject a non target being.

Detonation mechanisms are too traumatic on anything other than very large animals, can cause considerable tissue damage and are often non-reusable and expensive.

Hand driven mechanisms used in a pole are restricted to the length of the pole. The dissolution/absorption mechanism involves a slow delivery of the substance to the animal's circulatory system limiting its application. Hand thrown mechanisms are the most basic and least effective methods.

There are several known barrel based mechanisms such as blow pipes which are only effective at short range (5 m or less) and compressed air powered mechanisms which are only accurate to a range of 20 meters. If the compressed air mechanism uses pressurised carbon dioxide its effectiveness will vary according to the ambient temperature as well. Cartridge powered systems involve considerable forces and the system can end up quite complex with a number of adjustments required for each shot, creating a considerable margin for error. The system is also very noisy and the first shot usually disperses the target animals.

In summary, the barrel based mechanisms suffer from errors associated with variation in delivery pressures and the barrel limits the size of the syringe. The syringe used is also limited by the forces and temperatures of the barrel system. In dense scrub, these syringes can also be easily lost. Further the force with which the syringe is shot is such that the syringe may be damaged either leaving the barrel or as a result of the impact with the animal. Such systems are also not readily suited to use with wild animals. The sound of the shot is heard by the animal before the syringe reaches the animal and therefore the syringe may miss.

It would also be useful if animal syringe darts were available which could take samples of blood or tissue.

In the following description and in the claims reference is made to "tubular members". It will be understood by those skilled in the art that this term is meant to define an elongated member of substantially constant cross-section which may or may not be circular. The term envisages any cross-sectional shape such as oval, rectangular or triangular.

OBJECT OF THE INVENTION

It is an object of the present invention to provide an animal dart which may be projected from devices other than fire arms e.g. from crossbows or bows.

SUMMARY OF THE INVENTION

The invention is based upon the use of momentum absorption. In this system, the impact momentum is utilized by the apparatus. This system is more reliable as it only requires impact energy to effect injection or sampling. It is also superior to conventional systems in that a considerable reduction in force results from the absorption of impact momentum. This results in a less traumatic impact and a more consistent injection or sampling event.

According to a first form of the invention, a dart for administering an injection fluid to an animal is provided comprising:

(a) a tubular member having a front end closed by a penetrable closure;

(b) a syringe located within and movable longitudinally along the tubular member, the syringe having:
  (i) a barrel to receive injection fluid;
  (ii) a hollow needle extending from one end of the barrel towards the penetrable closure of the front end;
  (iii) a closure at the other end of the barrel;
  (iv) a plunger located in the barrel which is in sealing engagement with and movable along the barrel towards or away from the needle; and
  (v) an aperture or passageway in or extending from the barrel rearward of the plunger in its loaded position communicating between the tubular member and an area in the barrel rearward of the plunger; and (c) sealing means mounted on the syringe rearward of the aperture or passageway and sealingly engaging the tubular member to seal the syringe within the tubular member, wherein upon impact of the dart, the syringe is caused to move in a forward direction in the tubular member, the pressure in the tubular member between the penetrable closure and the sealing means increases until the needle penetrates through the closure; at the same time the pressure behind the plunger is increasing due to the passage of air through the aperture or passageway so that when the needle penetrates the closure the pressure differential between the area behind the plunger and the area in front of the hollow needle causes the injection fluid to be expelled.

In a preferred form of the invention, the barrel further includes a one way valve interposed between the plunger and the aperture or passageway. This one way valve permits air to pass into the area between the valve and the plunger but does not permit air to escape therefrom towards the aperture or passageway. In this preferred form, rebounding of the dart or leakage of air from the dart upon impact does not adversely effect the injection pressure applied to the plunger.

In another embodiment of the invention, the barrel is a pair of concentric tubes and the sealing means is interposed between the outer barrel and the tubular member. The concentric tubes define the passageway therebetween which communicates between the tubular member and the area rearward of the plunger.

Preferably, the tubular member has a separate tail section. In this embodiment, the momentum from the tail section is transferred directly to the plunger.

Preferably, the rear end of the tubular member has a rear vent. More preferably, the rear vent further includes a one-way valve to allow air to enter the tubular member. In this embodiment, the rear vent allows air to enter behind the syringe and thus prevents a vacuum forming which would adversely affect the injection pressure.

Upon impact with the target, the tubular member rapidly slows down, being at a much faster deceleration rate than that of the syringe causing the syringe to move toward the front end. This movement increases the pressure prevailing in the chamber between the sealing means and the penetrable closure. The continued movement of the syringe causes the needle to pierce the closure and by differential pressure, the injection fluid is injected into the target.

According to a second form of the invention, a dart for taking a sample from an animal is provided comprising:

(a) a tubular member having a front end closed by a penetrable closure and a rear end closed by an airtight closure;

(b) a syringe located within and movable longitudinally along the tubular member, the syringe having:

(i) a barrel to receive a sample;

(ii) a hollow needle extending from one end of the barrel towards the penetrable closure of the front end;

(iii) a closure at the other end of the barrel;

(iv) a plunger located in the barrel which is in sealing engagement with and movable along the barrel towards or away from the needle; and (v) an aperture or passageway in the barrel rearward of the plunger communicating between the tubular member and an area in the barrel rearward of the plunger; and (c) sealing means mounted on the syringe between the plunger and the aperture or passageway and sealingly engaging the tubular member to seal the syringe within the tubular member and inhibit air moving from the area about the needle to the area rearward of the sealing means, wherein upon impact of the dart, the syringe is caused to move in a forward direction in the tubular member, the pressure in the tubular member between the sealing means and the area rearward of the sealing means decreases until the needle penetrates through the closure; so that when the needle penetrates the closure the pressure differential between the area behind the sealing means and the area in front of the hollow needle causes the plunger to move towards the rear end of the tubular member to draw a sample through the needle into the barrel.

Preferably, the barrel further includes a one way valve interposed between the plunger and the aperture or passageway. This one way valve permits air to pass out of the area between the valve and the plunger but does not permit air to enter therefrom the aperture or passageway. In this preferred form, rebounding of the dart or leakage of air from the from the rear end airtight closure does not adversely effect the injection pressure applied to the plunger.

Preferably, the tubular member is formed as the bolt of an arrow, in which case it is provided with a set of outwardly directed vanes located at or adjacent the other end of the tubular member. In this embodiment when the arrow is projected the force applied to the syringe biases it initially towards the rear of the arrow.

The needle assembly is conventional in the sense that it is hollow and permits injection fluid to pass through it from the barrel. Preferably, the needle may additionally include ancillary means or be of enlarged bore to house a tag or solid implant materials or receive tissue samples. For example, it may be possible to include solid hormonal materials. In this arrangement, it would also be possible to select antiseptic fluid as the injection material to clean the implanted area simultaneously with the implanting action.

The penetrable closure may be fabricated from any material which can maintain the requisite pressure conditions yet be penetrated by conventional syringe needles.

The sealing means may be, for example, O-rings.

In a preferred embodiment, the syringe has a pleat with a smaller radius about the middle of the length of the barrel. The pleat prevents the plunger from moving past the pleat and thus maintaining the separation between an area in front of the pleat which will contain the injection fluid or receive the sample and the area rearward of the pleat.

In a preferred embodiment, the front end of the tubular member contains a nose plug which once the needle has passed through the penetrable closure receives the front end of the syringe and prevents it from moving further forward.

In a preferred embodiment, the syringe has radial detents on its inner wall. The detents prevent the closure in the syringe from moving past the radial detents.

Additionally the dart may include a breakable pocket associated with the penetrable closure to hold additional fluid to be applied to the target. For example, the pocket may contain dye so it will be readily apparent which targets have been treated or impacted by the dart.

In the arrow type embodiment of this invention, it is expected that the most suitable propulsion device will be a cross bow. These are strong, very accurate and essentially silent. This last feature is particularly important as animals will not be initially scared into movement.

In another embodiment of the invention, the dart is used in combination with a handle or other applications device adapted to cause the syringe of the dart to move forward and the needle to penetrate through the closure. In this arrangement the device will have an end which has a bore less than that of the tubular member.

According to a third form of the invention, there is provided a syringe for a tubular dart for administering an injection fluid to an animal comprising:

(a) a barrel to receive the injection fluid;

(b) a hollow needle extending from one end of the barrel;

(c) a closure at the other end of the barrel;

(d) a plunger located in the barrel which is in sealing engagement with and movable along the barrel towards or away from the needle;

(e) an aperture or passageway in or extending from the barrel rearward of the plunger in its loaded position communicating between an outer surface of the syringe and an area in the barrel rearward of the plunger; and (f) sealing means mounted on the syringe rearward of the aperture or passageway to sealingly engage the tubular dart.

According to a fourth form of the invention, there is provided a syringe for a tubular dart for taking a sample from an animal comprising:

(a) a barrel to receive the sample;

(b) a hollow needle extending from one end of the barrel;

(c) a closure at the other end of the barrel;

(d) a plunger located in the barrel which is in sealing engagement with and movable along the barrel towards or away from the needle;

(e) an aperture or passageway in the barrel rearward of the plunger in its loaded position communicating between an outer surface of the syringe and an area in the barrel rearward of the plunger; and (f) sealing means mounted on the syringe between the plunger and the aperture or passageway to sealingly engage the tubular dart.

Whilst it is anticipated that this dart will have principal applications with animals, it is equally adapted to use with humans.

The main significance of the dart of the invention is that the syringe becomes operable under the influence of its own momentum. This means, amongst other things, that:

the dart may be carried and stored both safely and indefinitely (injection fluid permitting), and it is not possible for it to inject anything without the use of a projecting mechanism;

the absorption of momentum inhibits bounce of the dart upon impact and subsequent failure to inject;

the absorption of momentum enables the projecting mechanism to fire the dart at higher velocity than would otherwise be possible which results in a consequent flatter and more accurate trajectory; and the absorption of momentum enables sensitive devices such as electronic tracking devices which may otherwise malfunction under the influence of excessive forces which are applied upon firing, to be fitted inside the dart.

Further, the needle may be encased (and protected) within the tubular member and therefore maintains its condition and sterility.

DESCRIPTION OF THE DRAWINGS

The invention will now be further explained and illustrated by reference to the accompanying drawings in which.

DETAILED DESCRIPTION

In the figures like elements are designated by the same numbers.

Figure 1A:
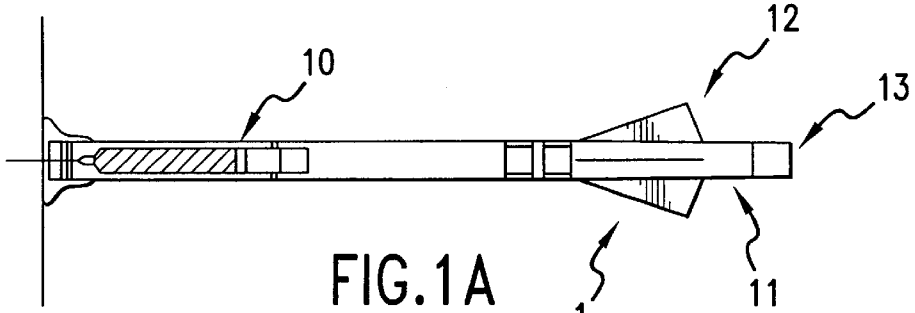
FIG. 1 are cross-sectional views of a dart according to the first form of the invention in the launch position B and impact position A.
Figure 1B:
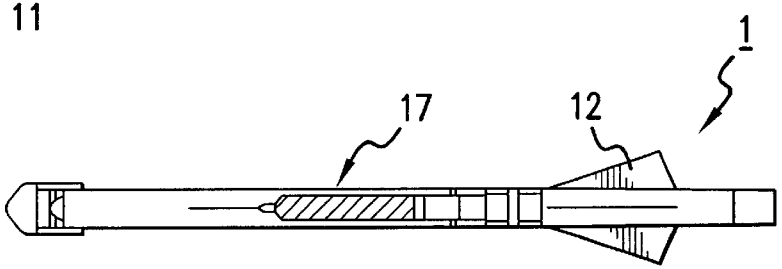
Figure 2:
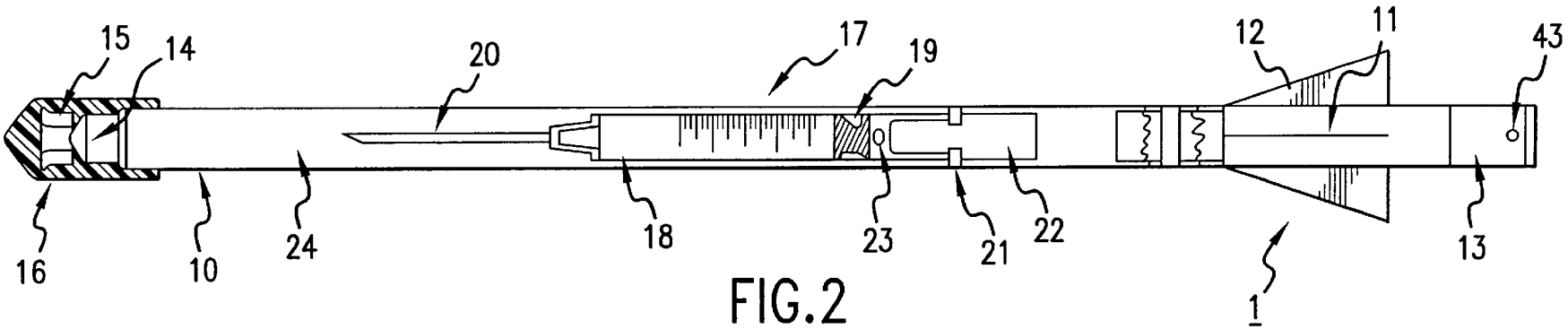
FIG. 2 is a detailed cross-sectional view of the dart according to FIG. 1.

Referring to FIGS. 1 & 2, a dart 1 is shown which includes a tubular member 10 having a tail section 11 on which vanes 12 are attached. The tail section 11 is closed by a plug 13. Closing the front section of the tubular member 10 is a seal 14 and a nose plug 15 which is a metal annulus. The plug 15 and seal 14 are covered by a plastic cap 16. This arrangement is a penetrable closure.

The tubular member 10 houses the syringe 17. The syringe 17 has a barrel 18, a plunger 19 and a needle 20. The syringe 17 is movable longitudinally in the tubular member 10 and has sealing O rings 21 there between mounted on a closure 22. An aperture 23 is located in the barrel 18 behind the plunger 19. Further, there is a rear vent 43 in the tail section of the dart to allow air to enter the tubular member.

As more particularly illustrated in FIG. 1 at position B, when the dart 1 is projected, the syringe 17 is biased toward the tail section 11. When the dart 1 impacts the target, the tubular member 10 decelerates but the syringe 17 does not slow down at the same rate and therefore the syringe 17 moves towards the penetrable closure. In doing so the forward air space 24 is reduced as the syringe 17 is sealingly engaging the tubular member 10. At that time, even though the pressure in the air space 24 is increasing that pressure is being uniformly applied to the syringe 17 and to the area (25—see FIG. 3) behind the plunger 19 via aperture 23. As such the injection fluid does not leak from the syringe 17.

As the syringe 17 continues to move under the influence of its momentum, the needle 20 penetrates the seal 14, and passes through the nose plug 15 and plastic cap 16. At this instance the pressure applied to the outlet of the needle 20 reduces to atmospheric whilst the pressure applied to the rear of plunger 19 is unchanged. This pressure differential causes the injection fluid to be forced through the needle into or onto the target. The rear vent 43 allows air to enter behind the syringe and thus prevents a vacuum forming which would adversely affect the injection pressure.

Figure 3:
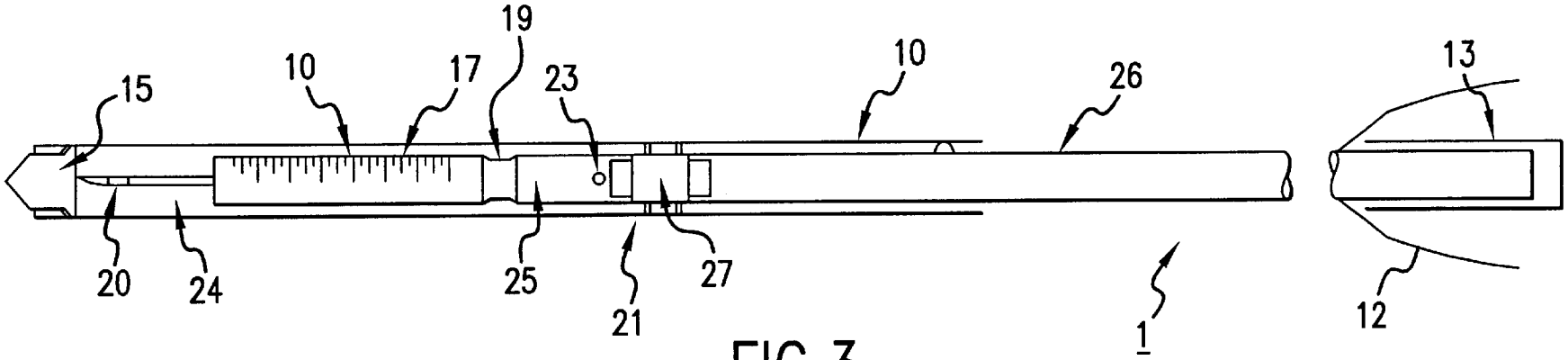
FIG. 3 is a cross-sectional view of a dart according to a second embodiment of the first form of the invention.

In FIG. 3, a modification to the system of FIG. 2 is depicted. In this arrangement the movement of the syringe 17 is augmented by the movement of a separate tail section 26. This section is slidingly and sealingly engaged in the tubular member 10 via a connector 27. The penetrable closure is a nose plug 15 made of rubber.

Upon impact the momentum of the tail section 26 is translated to the syringe 17 to which it is connected. The forward motion of the syringe 17 occurs in the same way as described in FIG. 2.

Figure 4:
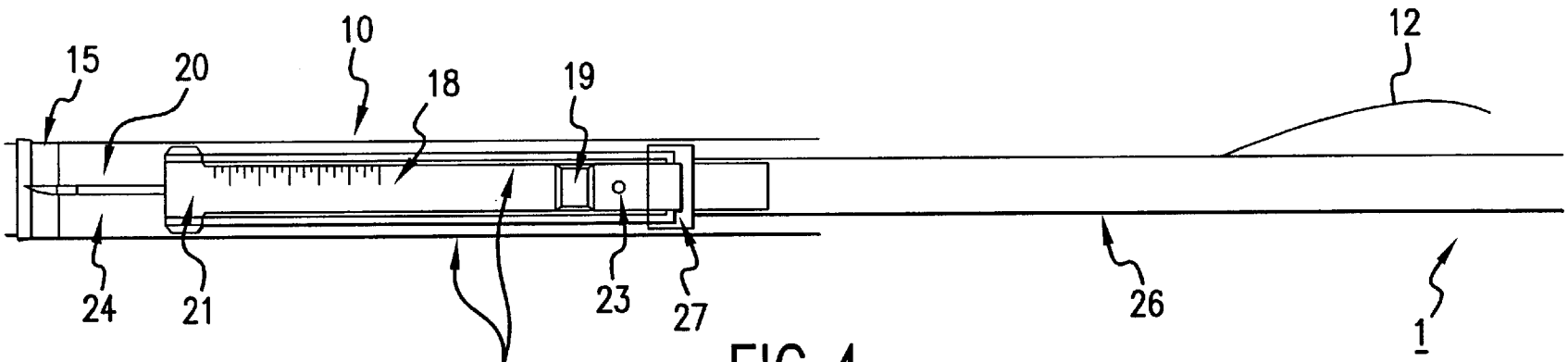
FIG. 4 is a cross-sectional view of a dart according to a third embodiment of the first form of the invention.

FIG. 4 shows a modification of FIG. 3 where the sealing O rings 21 are located near the needle assembly 20. To enable there to be constant pressure applied to the needle 14 and to the plunger 19 via aperture 23, a bypass tube 31 is provided concentric of the barrel 18. The tube 31 and the barrel 18 form a passageway between them that communicates with aperture 23.

Figure 5:
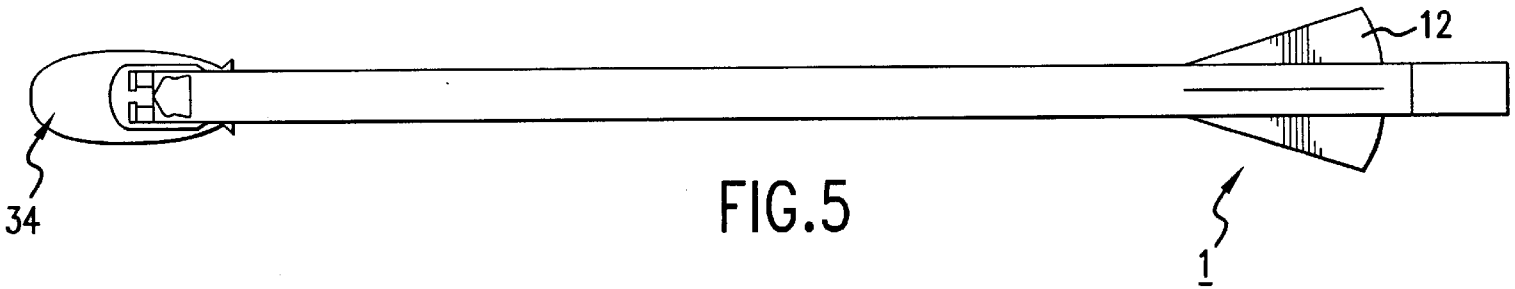
FIG. 5 is a cross-sectional view of a dart according to a fourth embodiment of the first form of the invention.

In FIG. 5, the dart of FIG. 1 has been modified by the addition of a pocket or capsule 34 which may contain additional fluid such as marking dye. On impact the capsule explodes by compression.

Figure 6:
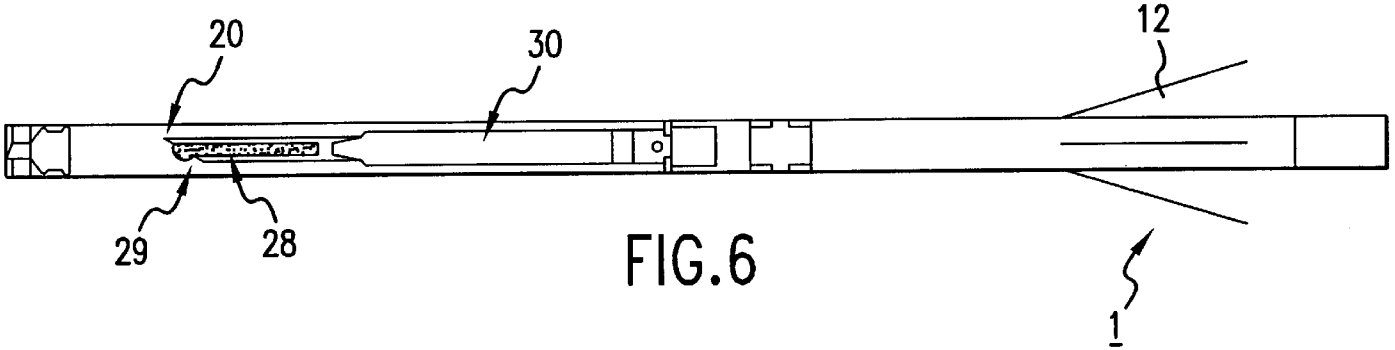
FIG. 6 is a cross-sectional view of a dart according to a fifth embodiment of the first form of the invention.

In FIG. 6, the dart of FIG. 1 is again modified by the use of a needle 20 which is provided with a large bore 28. An implant, such as solid hormones, may be located in the bore 28 and may have a barb 29 to ensure that it is retained in the target. In this arrangement the injection fluid may be substituted by an antiseptic fluid 30 which will then flood the surrounding area to the implant upon impact.

Figure 7:
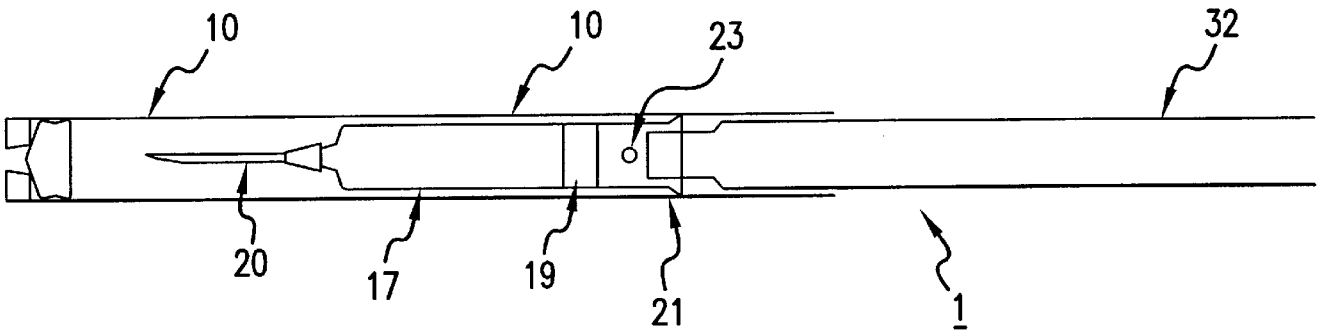
FIG. 7 is a cross-sectional view of a dart according to a sixth embodiment of the first form of the invention.

In FIG. 7 a modified version of FIG. 3 is shown by the provision of a handle 32 so that the dart is hand actuated. The handle 32 is connected to the syringe 17 and may be forced along tubular member 10 to cause the injection fluid to be expelled upon impact with the target.

Figure 8:
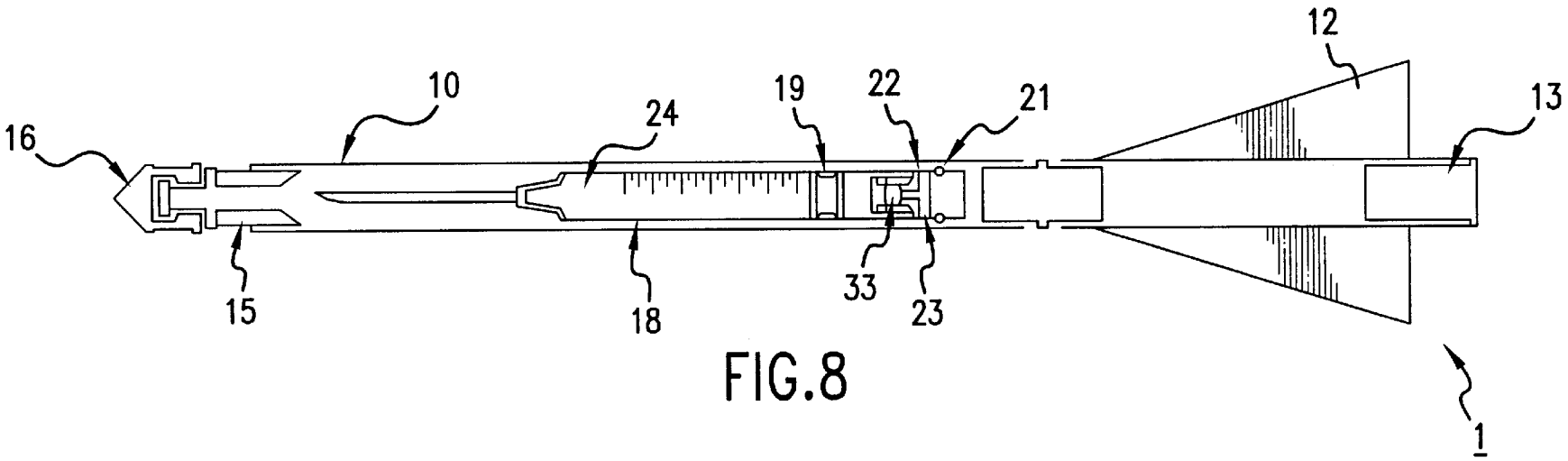
FIG. 8 is a modified form of the dart according to FIG. 2.

In FIG. 8, a variation of the arrangement described as FIG. 2 is shown. A one way valve 33 is interposed in the barrel 18 between the plunger 19 and the aperture 23. It sealingly engages and is fixed to the inner surface of the barrel 18. In operation, this one way valve 33 permits air passing through the aperture 23 to pass into the area between the valve 33 and the plunger 19 but does not permit air to escape therefrom towards the aperture 23.

Accordingly, even if upon impact there is any rebounding force upon the dart 1 or leakage of air from the dart 1, the pressure applied to the plunger 19 to complete the injection is unaffected.

Figure 9:
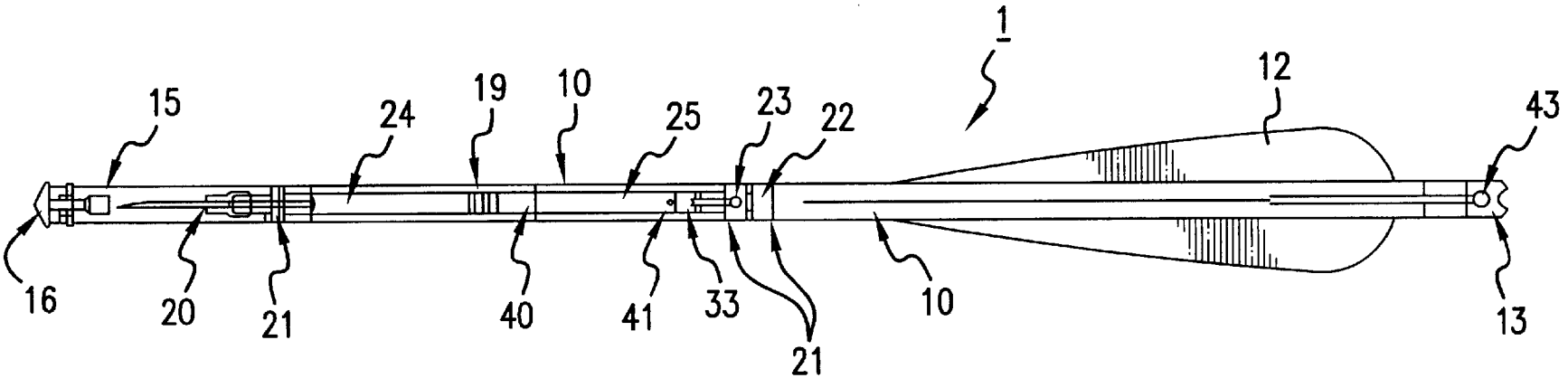
FIG. 9 is a cross-sectional view of a dart according to a seventh embodiment of the first form of the invention.

In FIG. 9, the dart of FIG. 1 is modified by the inclusion of a pleat 40 on the internal wall of the syringe 17 approximately in the middle of the length of the barrel. The pleat 40 has a smaller radius than the rest of the syringe 17. The pleat 40 prevents the plunger 19 from moving further backward and thus maintains the separation between the area 24 in front of the pleat 40 which will contain the injection fluid and the area rearward of the pleat 25.

Figure 10:
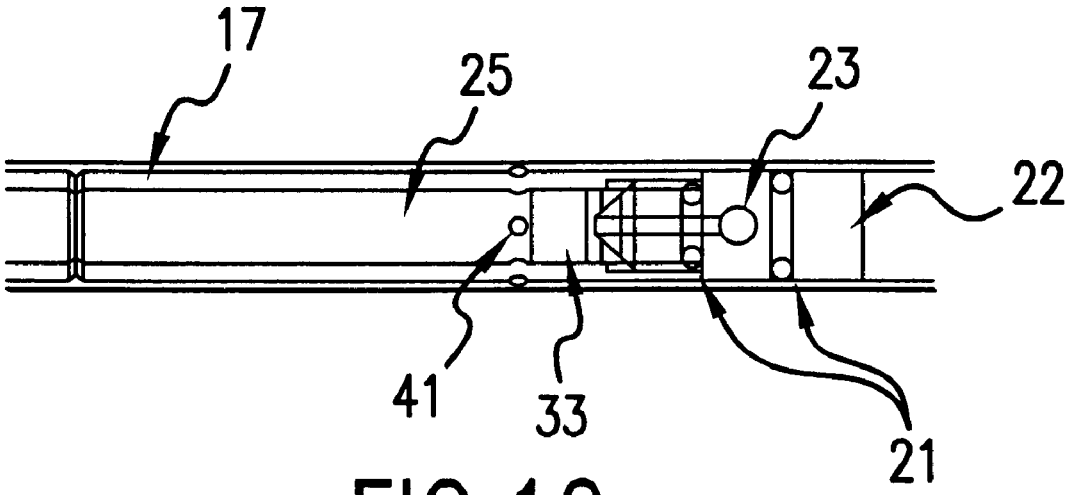
FIG. 10 is a partial cross-sectional view of the dart in FIG. 9.

The barrel 18 further includes radial detents 41 on its internal wall in the area between the closure 22 and the plunger 19. The radial detents 41 prevent the rear plug 22 from moving forward within the barrel 18. In the FIG. 10, it is clearly evident that the aperture 19 is located before the sealing means 21.

Figure 11:
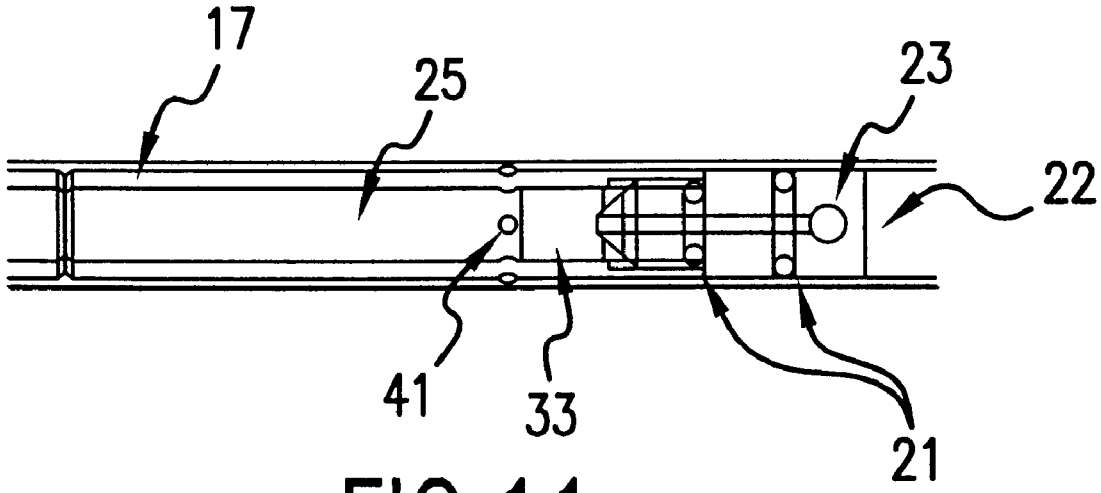
FIG. 11 is a partial cross-sectional view of a dart according to the second form of the invention.

In FIG. 11, a dart according to the second form of the invention is shown. In particular, the aperture 19 is located behind the sealing means 43. As a result when the syringe moves forward, the air from the area about the needle (not shown) cannot pass to the area rearward of the syringe 17. A vacuum or very low pressure area is thus formed behind the syringe 17. When the needle pierces penetrable closure, the pressure differential between the higher pressure about the needle and the low pressure behind the syringe 17 causes the plunger to move towards the rear of the barrel and a sample to be drawn into the barrel.

The word 'comprising' and forms of the word 'comprising' as used in this description does not limit the invention claimed to exclude any variants or additions.

Whilst various preferred forms of the invention have been described, various modifications and changes may be made and will be apparent to the skilled person in the art, without departing from the scope of the invention.

What is claimed is:

1. A dart for administering an injection fluid to an animal comprising:

(a) a tubular member having a front end closed by a penetrable closure;

(b) a syringe located within and movable longitudinally along the tubular member, the syringe having:

(i) a barrel to receive injection fluid;

(ii) a hollow needle extending from one end of the barrel towards the penetrable closure of the front end;

(iii) a closure at the other end of the barrel;

(iv) a plunger located in the barrel which is in sealing engagement with and movable along the barrel towards or away from the needle; and (v) an aperture or passageway in or extending from the barrel rearward of the plunger in its loaded position communicating between the tubular member and an area in the barrel rearward of the plunger; and (c) sealing means comprising one or more O-rings mounted on the syringe rearward of the aperture or passageway and sealingly engaging the tubular member to seal the syringe within the tubular member, wherein upon impact of the dart, the syringe is caused to move in a forward direction in the tubular member, the pressure in the tubular member between the penetrable closure and the sealing means increases until the needle penetrates through the closure; at the same time the pressure behind the plunger is increasing due to the passage of air through the aperture or passageway so that when the needle penetrates the closure the pressure differential between the area behind the plunger and the area in front of the hollow needle causes the injection fluid to be expelled.

2. A dart according to claim 1 wherein the rear end of the tubular member has a rear vent.

3. A dart according to claim 2 wherein the rear vent further includes a one way valve which allows air to enter the tubular member.

4. A dart according to claim 1 wherein the barrel is a pair of concentric tubes and the sealing means is interposed between the outer barrel and the tubular member, wherein the concentric tubes define the passageway.

5. A dart according to claim 1 wherein the tubular member is formed as a bolt of an arrow and has a set of outwardly directed vanes located at or adjacent the other end of the tubular member.

6. A dart according to claim 1 wherein the hollow needle has an enlarged bore.

7. A dart according to claim 1 wherein the dart further includes a breakable pocket associated with the penetrable closure.

8. A dart according to claim 1 wherein the tubular member has a separate tail section.

9. A dart according to claim 1 wherein the syringe has a pleat about the middle along the length of the barrel, wherein the pleat prevents the plunger from moving past the pleat.

10. A dart according to claim 1 wherein the barrel has radial detents on its inner wall rearward of the plunger, wherein the radial detents prevent the closure from moving past the radial detents.

11. A dart according to claim 1 wherein the front end of the tubular member further includes a nose plug which prevents the syringe from moving further forward.

12. A dart according to claim 1 wherein the barrel further includes a one-way valve interposed between the plunger and the aperture or passageway.

13. A dart for administering a sample from an animal comprising:

(a) a tubular member having a front end closed by a penetrable closure and a rear end closed by an airtight closure;

(b) a syringe located within and movable longitudinally along the tubular member, the syringe having:

(i) a barrel to receive a sample;

(ii) a hollow needle extending from one end of the barrel towards the penetrable closure of the front end;

(iii) a closure at the other end of the barrel;

(iv) a plunger located in the barrel which is in sealing engagement with and movable along the barrel towards or away from the needle; and (v) an aperture or passageway in the barrel rearward of the plunger communicating between the tubular member and an area in the barrel rearward of the plunger; and (c) sealing means comprising one or more O-rings mounted on the syringe between the plunger and the aperture or passageway and sealingly engaging the tubular member to seal the syringe within the tubular member and inhibit air moving from the area about the needle to the area rearward of the sealing means, wherein upon impact of the dart, the syringe is caused to move in a forward direction in the tubular member, the pressure in the tubular member between the sealing means and the area rearward of the sealing means decreases until the needle penetrates through the closure; so that when the needle penetrates the closure the pressure differential between the area behind the sealing means and the area in front of the hollow needle causes the plunger to move towards the rear end of the tubular member to draw a sample through the needle into the barrel.

14. A dart according to claim 13 wherein the barrel further includes a one-way valve interposed between the plunger and the aperture or passageway.

15. A dart according to claim 13 wherein the tubular member is formed as a bolt of an arrow and has a set of outwardly directed vanes located at or adjacent the rear end of the tubular member.

16. A dart according to claim 13 wherein the hollow needle has an enlarged bore.

17. A dart according to claim 13 wherein the dart further includes a breakable pocket associated with the penetrable closure.

18. A dart according to claim 13 wherein the syringe has a pleat about the middle along the length of the barrel wherein the pleat prevents the plunger from moving past the pleat.

19. A dart according to claim 13 wherein the barrel has radial detents on its inner wall rearward of the plunger; wherein the radial detents prevent the closure from past the radial detents.

20. A dart according to claim 13 wherein the front end of the tubular member further includes a nose plug which prevents the syringe from moving further forward.

* * * * *